US010461403B2

(12) United States Patent
Ikeda et al.

(10) Patent No.: US 10,461,403 B2
(45) Date of Patent: Oct. 29, 2019

(54) ANTENNA DEVICE

(71) Applicant: DENSO CORPORATION, Kariya, Aichi-pref. (JP)

(72) Inventors: Masakazu Ikeda, Nishio (JP); Hiroaki Kuraoka, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/510,603

(22) PCT Filed: Sep. 23, 2015

(86) PCT No.: PCT/JP2015/004830
§ 371 (c)(1),
(2) Date: Mar. 10, 2017

(87) PCT Pub. No.: WO2016/056190
PCT Pub. Date: Apr. 14, 2016

(65) Prior Publication Data

US 2017/0288299 A1 Oct. 5, 2017

(30) Foreign Application Priority Data

Oct. 7, 2014 (JP) ..... 2014-206418

(51) Int. Cl.
*H01Q 1/24* (2006.01)
*H01Q 1/52* (2006.01)
(Continued)

(52) U.S. Cl.
CPC ..... *H01Q 1/243* (2013.01); *H01Q 1/52* (2013.01); *H01Q 9/0421* (2013.01);
(Continued)

(58) Field of Classification Search
CPC .... H01Q 9/0421; H01Q 9/0442; H01Q 1/243; H01Q 1/52; H01Q 13/08; H01Q 9/0457
See application file for complete search history.

(56) References Cited

U.S. PATENT DOCUMENTS 5,539,418 A * 7/1996 Egashira ..... H01Q 1/3275 343/712
6,794,961 B2 * 9/2004 Nagaishi ..... H01L 23/552 257/E23.114

(Continued)

FOREIGN PATENT DOCUMENTS

JP H09064636 A 3/1997
JP 2004320431 A 11/2004

*Primary Examiner* — Dameon E Levi
*Assistant Examiner* — Jennifer F Hu
(74) *Attorney, Agent, or Firm* — Harness, Dickey & Pierce, P.L.C.

(57) ABSTRACT

An antenna device includes a first conductive plate in a board shape, a second conductive plate in a board shape, a short-circuiting section, and a connecting section. The second conductive plate is disposed to face the first conductive plate with a space therebetween. The short-circuiting section is disposed between the first conductive plate and the second conductive plate, has a housing space housing an electronic component, and is connected to both the first conductive plate and the second conductive plate. The connecting section extends from the electronic component disposed inside the short-circuiting section toward the outside of the short-circuiting section without being electrically connected to the short-circuiting section and the first conductive plate, and extends between the first conductive plate and the second conductive plate from the outside of the short-circuiting section without being electrically connected to the first conductive plate, to be electrically connected to the second conductive plate.

4 Claims, 7 Drawing Sheets

(51) Int. Cl.
*H01Q 13/08* (2006.01)
*H01Q 23/00* (2006.01)
*H01Q 9/04* (2006.01)

(52) U.S. Cl.
CPC ..... *H01Q 9/0442* (2013.01); *H01Q 13/08* (2013.01); *H01Q 23/00* (2013.01)

(56) References Cited

U.S. PATENT DOCUMENTS

| | | | | |
|---|---|---|---|---|
| 8,963,793 | B2 * | 2/2015 | Saliga | H01Q 9/0407 343/700 MS |
| 2001/0007445 | A1 * | 7/2001 | Pankinaho | H01Q 1/243 343/844 |
| 2002/0075192 | A1 * | 6/2002 | Iwai | H01Q 1/243 343/702 |
| 2002/0135522 | A1 * | 9/2002 | Yamamoto | H01Q 21/007 343/702 |
| 2002/0140612 | A1 * | 10/2002 | Kadambi | H01Q 9/0421 343/702 |
| 2003/0146878 | A1 * | 8/2003 | Mikkola | H01Q 1/243 343/702 |
| 2004/0061652 | A1 * | 4/2004 | Ishihara | H01Q 9/0421 343/752 |
| 2004/0183735 | A1 * | 9/2004 | Jecko | H01Q 9/0421 343/725 |
| 2016/0028162 | A1 * | 1/2016 | Ou | H01Q 9/0457 343/905 |

* cited by examiner

E1
E1
E1

ANTENNA DEVICE

CROSS REFERENCE TO RELATED APPLICATIONS

This application is a U.S. National Phase Application under 35 U.S.C. 371 of International Application No. PCT/JP2015/004830 filed on Sep. 23, 2015 and published in Japanese as WO 2016/056190 A1 on Apr. 14, 2016. This application is based on and claims the benefit of priority from Japanese Patent Application No. 2014-206418 filed on Oct. 7, 2014. The entire disclosures of all of the above applications are incorporated herein by reference.

TECHNICAL FIELD

The present disclosure relates to an antenna device that has a short-circuiting section.

BACKGROUND ART

A planar antenna device has hitherto been known, which includes a dielectric member having a recess in a bottom surface, a radiation electrode formed on the upper face of the dielectric member, a ground electrode formed on the bottom surface and in the recess of the dielectric member, electronic components disposed in the recess and connected to the radiation electrode and ground electrode, and a lid that covers the recess (see, for example, Patent Literature 1).

Such a planar antenna device can have built-in electronic components so that the entire thickness including the electronic components and planar antenna device can be reduced as compared to a configuration where the electronic components are disposed outside the planar antenna device. Such a planar antenna device can provide an electromagnetic shield for the electronic components by the ground electrode and the lid.

PRIOR ART LITERATURES

Patent Literature

Patent Literature 1: JPH9-64636A

SUMMARY OF INVENTION

However, when electromagnetically shielded electronic components are built in the planar antenna device, the electric fields generated inside the planar antenna device may be affected by the electronic components housed inside the planar antenna device, which may lead to performance degradation of the planar antenna device.

The present disclosure has been made in view of these issues, its object being to minimize a loss in antenna performance resulting from built-in electronic components.

According to a first aspect of the present disclosure, an antenna device includes a first conductive plate, a second conductive plate, a short-circuiting section, and a connecting section.

The first conductive plate is a conductor formed in a board shape. The second conductive plate is a conductor formed in a board shape and disposed to face the first conductive plate with a space therebetween.

The short-circuiting section is a conductor disposed between the first conductive plate and the second conductive plate, has a housing space formed for housing an electronic component, and is connected to both the first conductive plate and the second conductive plate.

The connecting section is a conductor that extends from the electronic component disposed inside the short-circuiting section toward the outside of the short-circuiting section without being electrically connected to the short-circuiting section and the first conductive plate, and extends between the first conductive plate and the second conductive plate from the outside of the short-circuiting section without being electrically connected to the first conductive plate, to be electrically connected to the second conductive plate.

In the antenna device configured as described above, electric current flows along a path that starts from the electronic component inside the short-circuiting section and reaches the second conductive plate via the connecting section, and extends further from the second conductive plate and reaches the first conductive plate via the short-circuiting section.

Therefore, the antenna device can transmit electrical signals to the radiation electrode via the electronic component, and transmit electrical signals from the radiation electrode to the electronic component, in both a case where the first conductive plate is the ground electrode and the second conductive plate is the radiation electrode, and a case where the first conductive plate is the radiation electrode and the second conductive plate is the ground electrode.

Since the short-circuiting section is a conductor that is connected to both the first conductive plate and the second conductive plate, the short-circuiting section has a ground potential. Therefore, the electronic component housed inside the short-circuiting section is hardly affected by the electric fields generated outside the short-circuiting section.

Since the electronic component is housed inside the short-circuiting section, the electric fields generated between the first conductive plate and the second conductive plate are hardly affected by the electronic component inside the short-circuiting section.

In this way, the antenna device can minimize a loss in antenna performance resulting from the built-in electronic component.

According to a second aspect of the present disclosure, an antenna device includes a first conductive plate, a second conductive plate, a short-circuiting section, and a connecting section.

The short-circuiting section is a conductor disposed between the first conductive plate and the second conductive plate, has a housing space formed for housing an antenna, and is connected to both the first conductive plate and the second conductive plate. The connecting section is a conductor electrically connected to the first conductive plate.

The antenna device configured as described above can transmit electrical signals to the radiation electrode via the connecting section, and transmit electrical signals from the radiation electrode to the outside of the antenna device, when the first conductive plate is the radiation electrode and the second conductive plate is the ground electrode.

Since the short-circuiting section is a conductor that is connected to both the first conductive plate and the second conductive plate, the short-circuiting section has a ground potential. Therefore, the antenna housed inside the short-circuiting section is hardly affected by the electric fields generated between the first conductive plate and the second conductive plate.

Since the antenna is housed inside the short-circuiting section, the electric fields generated between the first conductive plate and the second conductive plate are hardly affected by the antenna inside the short-circuiting section.

In this way, the antenna device can minimize a loss in antenna performance resulting from the built-in antenna.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

First Embodiment

Hereinafter, a first embodiment of the present disclosure will be described with reference to the drawings.

Figure 1:
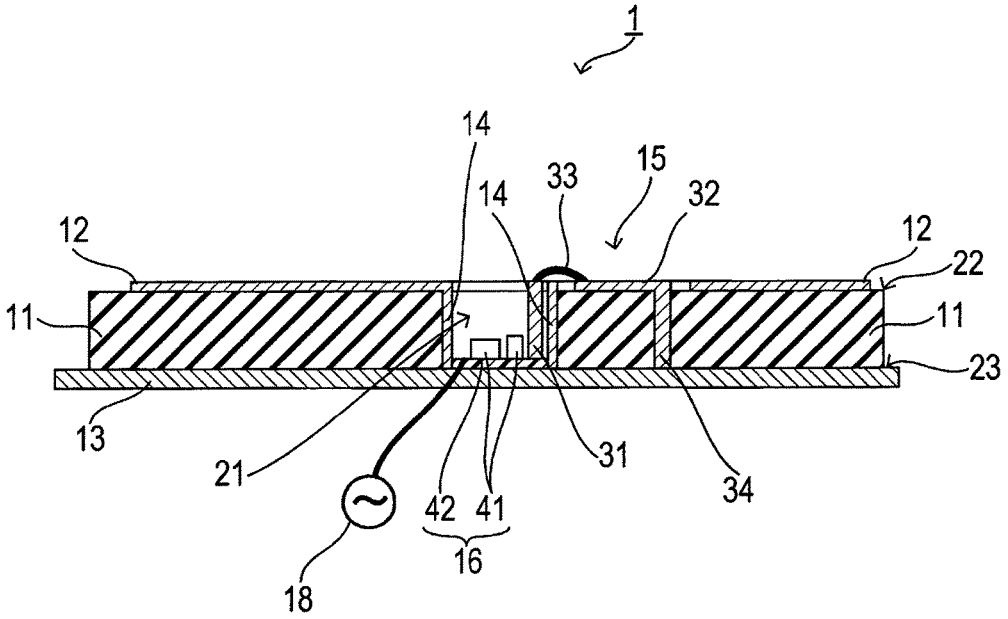
FIG. 1 is a cross-sectional view illustrating a planar antenna device 1 of a first embodiment.

A planar antenna device 1 of the present embodiment includes a dielectric member 11, an upper flat board 12, a ground board 13, a short-circuiting section 14, a power feed conductor 15, and a circuit section 16, as shown in FIG. 1. FIG. 1 is a cross-sectional view taken along arrow I-I in FIG. 2.

Figure 2:
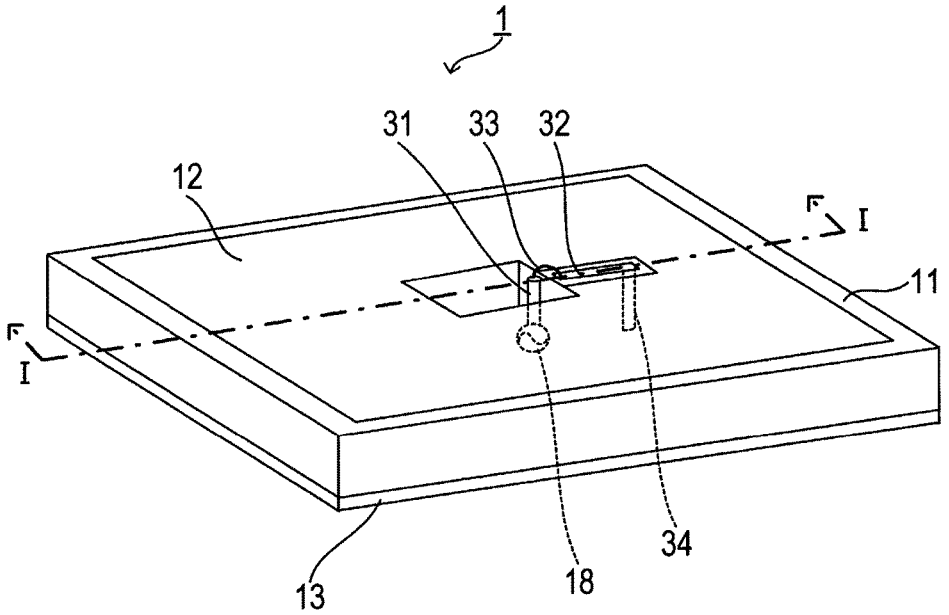
FIG. 2 is a perspective view illustrating the planar antenna device 1 of the first embodiment.

The dielectric member 11 is formed in a rectangular plate-like shape (see FIG. 2). A through hole 21 is formed in the dielectric member 11 to extend through the dielectric member 11. The through hole 21 has a size capable of housing the circuit section 16 therein.

The upper flat board 12 is a conductive plate disposed to be in contact with an upper face 22 of the dielectric member 11. The dielectric member 11 is rectangular plate shaped. The upper flat board 12 is formed in a rectangular plate-like shape of a size that does not cover the peripheral edge of the upper face 22 (see FIG. 2). The upper flat board 12 further has openings formed therein in a portion that faces the through hole 21 and in a portion where a feed line 32 is disposed.

The ground board 13 is a conductive plate disposed to be in contact with a lower face 23 of the dielectric member 11. The ground board 13 is formed to entirely cover the lower face 23. The ground board 13 is formed to close the through hole 21 in the portion that faces the through hole 21.

The short-circuiting section 14 is a conductor that is formed over the entire inner circumferential surface of the through hole 21. Thus, the short-circuiting section 14 electrically connects the upper flat board 12 and the ground board 13.

The power feed conductor 15 includes a feed pin 31, the feed line 32, a feed wire 33, and a feed pin 34.

The feed pin 31 is a rod-like conductor and disposed inside the through hole 21 with one end connected to the circuit section 16.

The feed line 32 is a strip line arranged to be in contact with the upper face 22 of the dielectric member 11. The upper flat board 12 has an opening formed in a portion where the feed line 32 is disposed as mentioned above. Therefore, the feed line 32 and the upper flat board 12 are electrically insulated from each other.

The feed wire 33 is a conductive wire with a first end connected to the feed pin 31 and a second end connected to the feed line 32. Thus, the feed wire 33 electrically connects the feed pin 31 and the feed line 32.

The feed pin 34 is a rod-like conductor and disposed to extend through the dielectric member 11. The feed pin 34 has a first end connected to the feed line 32 and a second end connected to the ground board 13. Thus, the feed pin 34 electrically connects the feed line 32 and the ground board 13.

The circuit section 16 includes electronic components 41 and a circuit board 42.

The electronic components 41 are configured by an impedance matching circuit for impedance matching with a coaxial cable that connects a feed section 18 and the planar antenna device 1, and an amplifying circuit that amplifies a high frequency signal output from the feed section 18.

The circuit board 42 is formed in a board shape and carries the electronic components 41 mounted on the upper surface of the circuit board 42. The circuit board 42 is disposed inside the through hole 21 with the underside of the circuit board 42 in contact with the ground board 13. Thus the circuit section 16 is housed inside the through hole 21.

Figure 3:
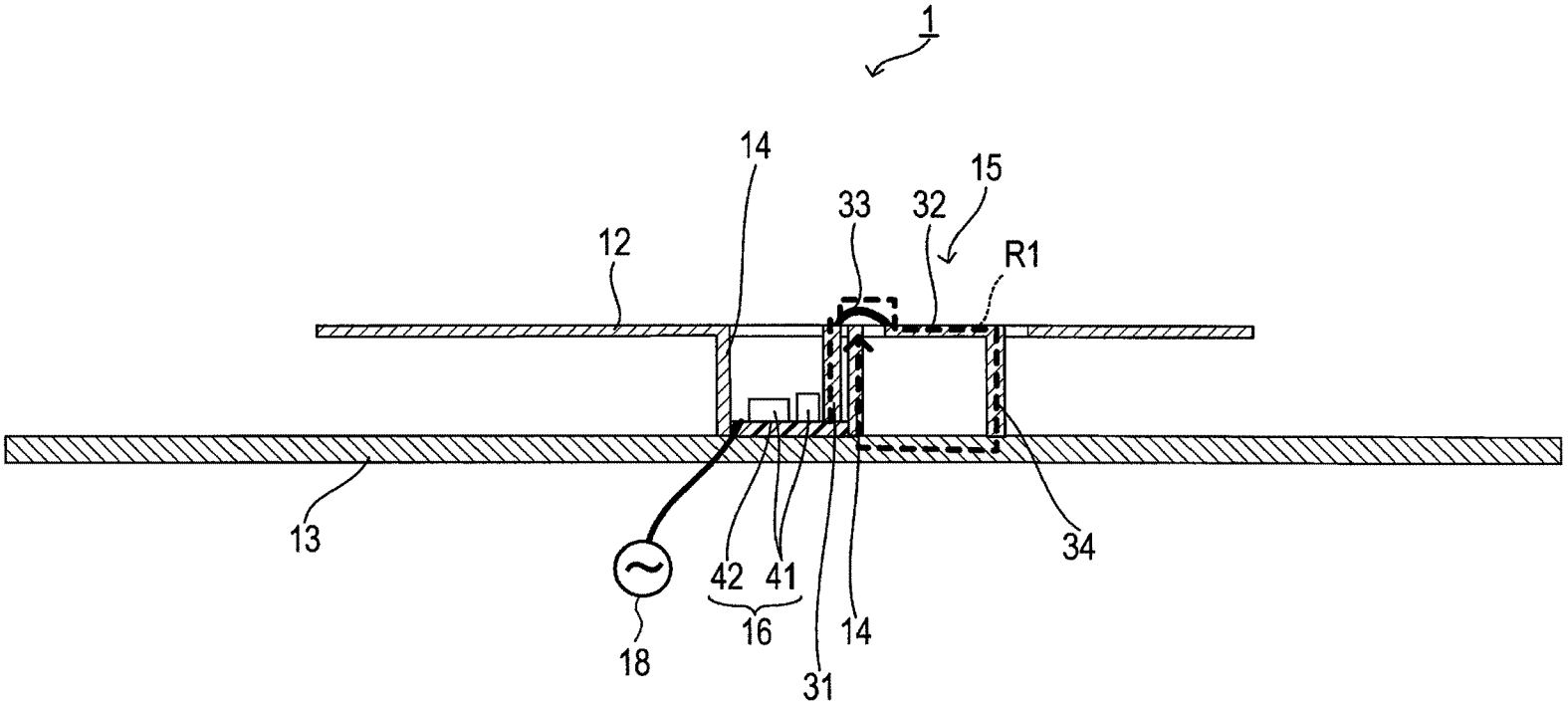
FIG. 3 is a cross-sectional view illustrating a current path R1 of the planar antenna device 1 of the first embodiment.
Figure 4:
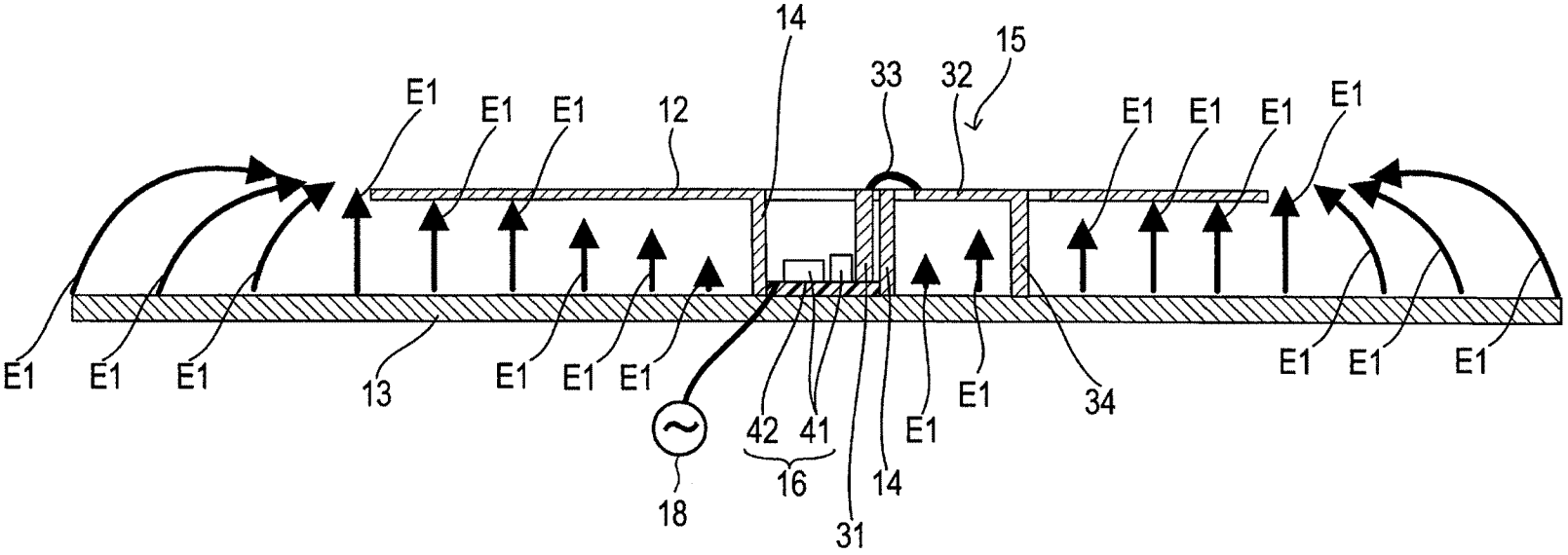
FIG. 4 is a cross-sectional view illustrating an electric field distribution of the planar antenna device 1 of the first embodiment.

In the planar antenna device 1 configured as described above, electric current flows along a current path R1 that starts from the circuit section 16 and reaches the upper flat board 12 via the power feed conductor 15, the ground board 13, and the short-circuiting section 14, as shown in FIG. 3. Thus, the planar antenna device 1 generates vertical electric fields E1 between the upper flat board 12 and the ground board 13 as shown in FIG. 4 and emits radio waves from the edges of the upper flat board 12.

As described above, the planar antenna device 1 includes the upper flat board 12, the ground board 13, the short-circuiting section 14, and the power feed conductor 15.

The upper flat board 12 is a conductor formed in a board shape. The ground board 13 is a conductor formed in a board shape and disposed to face the upper flat board 12 with a space therebetween.

The short-circuiting section 14 is a conductor disposed between the upper flat board 12 and the ground board 13, has the through hole 21 formed for housing the electronic components 41, and is connected to both the upper flat board 12 and the ground board 13.

The power feed conductor 15 is a conductor that extends from an electronic component 41 disposed inside the short-circuiting section 14 toward the outside of the short-circuiting section 14 without being electrically connected to the short-circuiting section 14 and the upper flat board 12, and extends between the upper flat board 12 and the ground board 13 from the outside of the short-circuiting section 14 without being electrically connected to the upper flat board 12, to be electrically connected to the ground board 13.

In the planar antenna device 1 configured as described above, electric current flows along a path that starts from an electronic component 41 inside the short-circuiting section 14 and reaches the ground board 13 via the power feed conductor 15, and extends further from the ground board 13 and reaches the upper flat board 12 via the short-circuiting section 14.

Thus, the planar antenna device 1 can transmit electrical signals to the upper flat board 12 via the electronic components 41.

Since the short-circuiting section 14 is a conductor that is connected to both the upper flat board 12 and the ground board 13, the short-circuiting section 14 has a ground potential. Therefore, the influence of radiation electric fields of the planar antenna device 1 on the electronic components 41 housed inside the short-circuiting section 14 is very little, i.e., the electronic components are hardly affected by the electric fields generated outside the short-circuiting section 14 at an operating frequency in a zeroth mode.

The zeroth mode is a mode showing horizontally nondirectional, vertically polarized radiation characteristics by generation of vertical electric fields having the same phase between the upper flat board 12 and the ground board 13 when the upper flat board 12 is small relative to the wavelength as compared to a primary mode that will be described below. The primary mode is a mode showing azimuth direction radiation characteristics by formation of a sinusoidal electric current distribution in the upper flat board 12 when the length of one side of the upper flat board 12 is about half a wavelength.

Since the electronic components 41 are housed inside the short-circuiting section 14, the electric fields generated between the upper flat board 12 and the ground board 13 are hardly affected by the electronic components 41 inside the short-circuiting section 14.

In this way, the planar antenna device 1 can minimize a loss in antenna performance resulting from the built-in electronic components 41.

Figure 5:
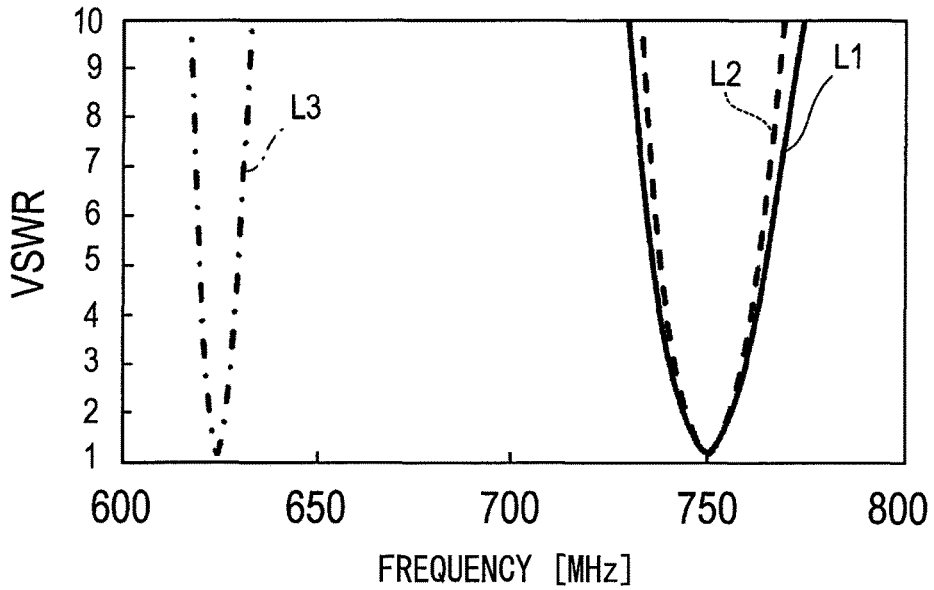
FIG. 5 is a graph showing frequency characteristics of VSWR.

FIG. 5 is a graph showing frequency characteristics of voltage standing wave ratio (VSWR) of the planar antenna device 1, a planar antenna device having electronic components 41 set between the upper flat board 12 and the ground board 13, and a planar antenna device that is the same as the planar antenna device 1 but without the electronic components 41.

As shown in FIG. 5, the voltage standing wave ratio of the planar antenna device 1 (see curve L1) shows hardly any change as compared to the voltage standing wave ratio of the planar antenna device that is the same as the planar antenna device 1 but without the electronic components 41 (see curve L2). On the other hand, the voltage standing wave ratio of the planar antenna device with electronic components 41 set between the upper flat board 12 and the ground board 13 (see curve L3) shows a change in the operating frequency as well as a decrease in the operating bandwidth, as compared to the voltage standing wave ratio of the planar antenna device that is the same as the planar antenna device 1 but without the electronic components 41 (see curve L2).

In the embodiment described above, the planar antenna device 1 corresponds to an antenna device in the present disclosure. The upper flat board 12 corresponds to a first conductive plate in the present disclosure. The ground board 13 corresponds to a second conductive plate in the present disclosure. The through hole 21 corresponds to a housing space in the present disclosure. The short-circuiting section 14 corresponds to a short-circuiting section in the present disclosure. The power feed conductor 15 corresponds to a connecting section in the present disclosure.

Second Embodiment

Hereinafter, a second embodiment of the present disclosure will be described with reference to the drawings. The second embodiment will be described with respect to features different from the first embodiment.

Figure 6:
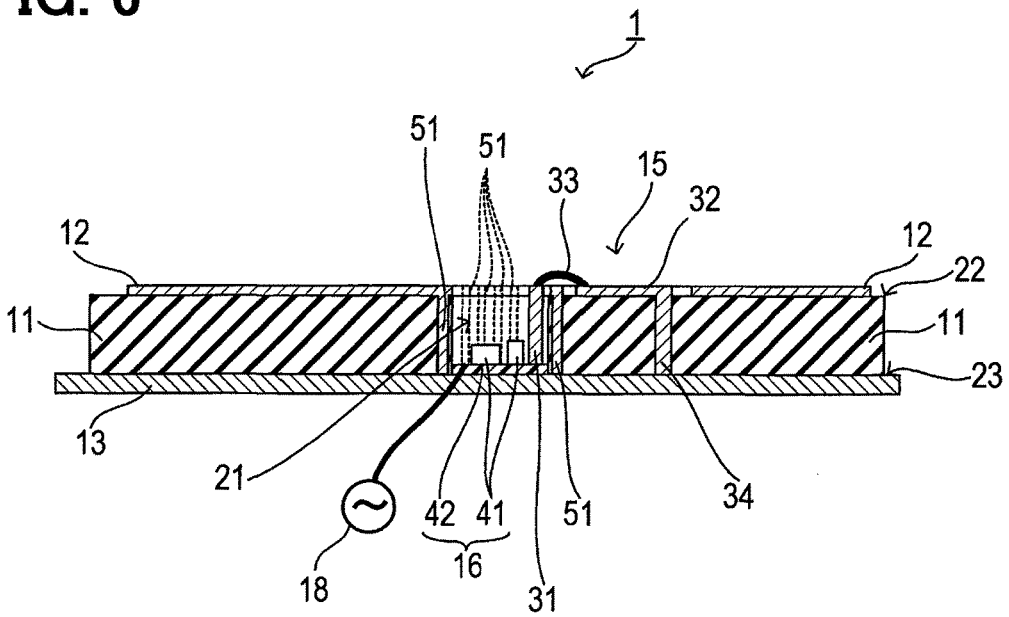
FIG. 6 is a cross-sectional view illustrating the planar antenna device 1 of a second embodiment.
Figure 7:
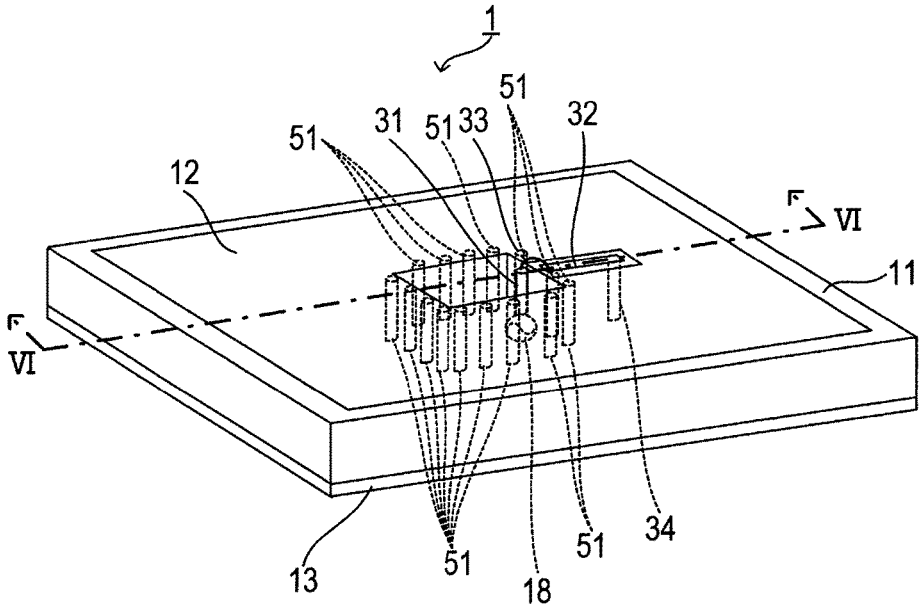
FIG. 7 is a perspective view illustrating the planar antenna device 1 of the second embodiment.

The planar antenna device 1 of the second embodiment is the same as the first embodiment except that a plurality of through hole conductors 51 are provided instead of the short-circuiting section 14, as shown in FIG. 6 and FIG. 7. FIG. 6 is a cross-sectional view taken along arrow VI-VI in FIG. 7.

The through hole conductors 51 are conductors formed inside the dielectric member 11 so as to extend through the dielectric member 11. Thus, the through hole conductors 51 electrically connect the upper flat board 12 and the ground board 13. The through hole conductors 51 are disposed outside the through hole 21 so as to surround the through hole 21.

In the planar antenna device 1 configured as described above, a short-circuiting section having a housing space for housing electronic components inside can be formed with a simple method in which through holes that extend through the dielectric member 11 are formed outside the through hole 21, and then conductors are formed inside the through holes by a plating process.

Third Embodiment

Hereinafter, a third embodiment of the present disclosure will be described with reference to the drawings.

Figure 8:
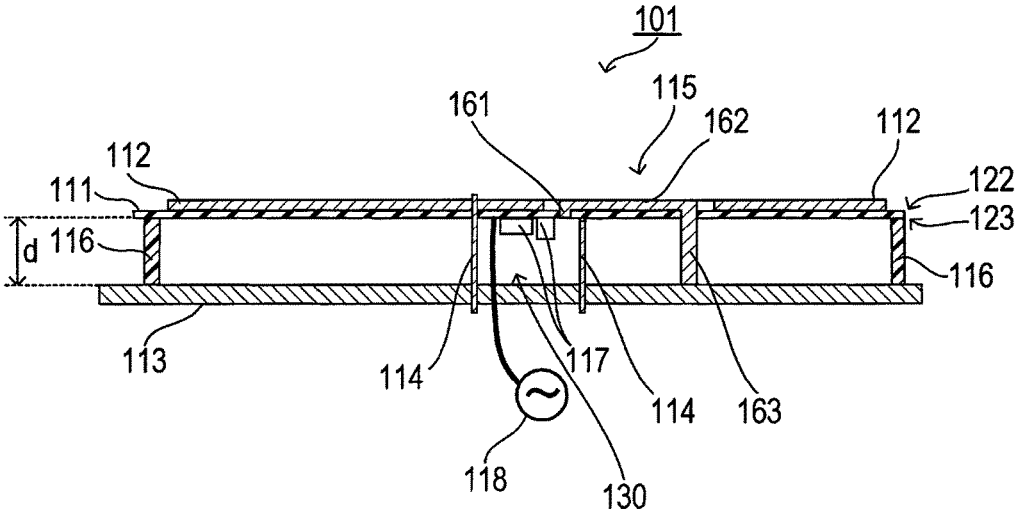
FIG. 8 is a cross-sectional view illustrating a planar antenna device 101 of a third embodiment.

A planar antenna device 101 of the present embodiment includes a dielectric member 111, an upper flat board 112, a ground board 113, a short-circuiting section 114, a power feed conductor 115, spacers 116, and electronic components 117, as shown in FIG. 8. FIG. 8 is a cross-sectional view taken along arrow VIII-VIII in FIG. 9.

The dielectric member 111 is formed in a rectangular plate-like shape (see FIG. 9) and used as a printed board for mounting electronic components 117.

The upper flat board 112 is a conductive plate disposed to be in contact with an upper face 122 of the dielectric member 111. The dielectric member 111 is rectangular plate shaped. The upper flat board 112 is formed in a rectangular plate-like shape of a size that does not cover the peripheral edge of the upper face 122 (see FIG. 9). The upper flat board 112 has an opening formed in a portion where a feed line 162 is disposed.

The ground board 113 is a conductive plate disposed to face a lower face 123 of the dielectric member 111 with the spacers 116 interposed between the ground board 113 and the dielectric member 111.

Figure 9:
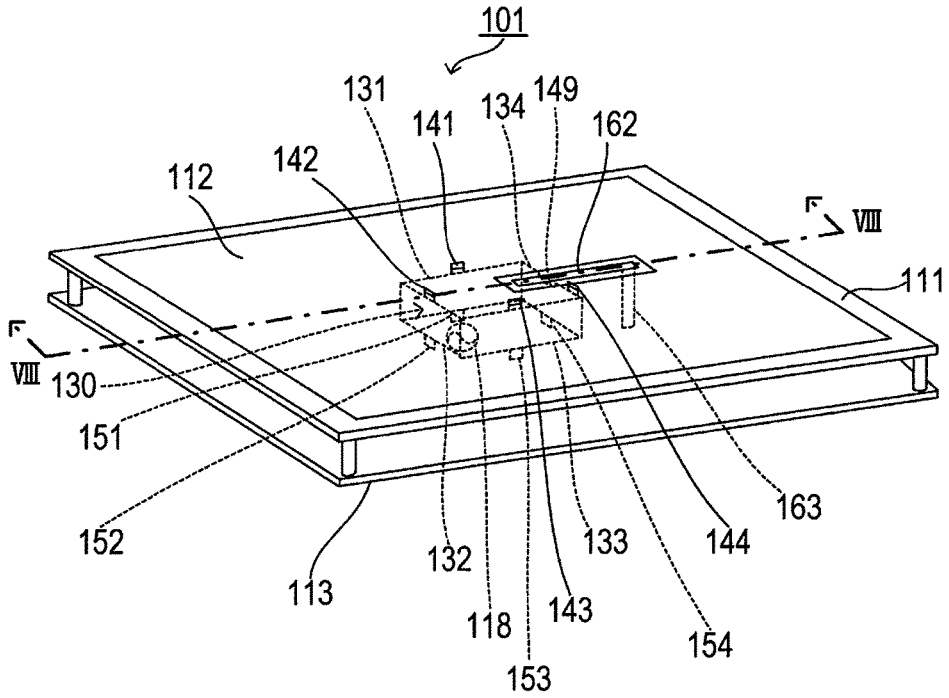
FIG. 9 is a perspective view illustrating the planar antenna device 101 of the third embodiment.

The short-circuiting section 114 has four side plates 131, 132, 133, and 134 arranged between the dielectric member 111 and the ground board 113 in a rectangular, tubular shape as shown in FIG. 9. The interior of the rectangular tubular short-circuiting section 114 forms the housing space 130 for housing the electronic components 117.

The side plates 131, 132, 133, and 134 are formed rectangular, and have upper connecting pieces 141, 142, 143, and 144 provided on one of the four sides of the rectangle that makes contact with the dielectric member 111. Lower connecting pieces 151, 152, 153, and 154 are provided to the side plates 131, 132, 133, and 134 on one of the four sides of the rectangle that makes contact with the ground board 113.

The upper connecting pieces 141, 142, 143, and 144 protrude from the side plates 131, 132, 133, and 134 to extend through the dielectric member 111 and the upper flat board 112. The lower connecting pieces 151, 152, 153, and 154 protrude from the side plates 131, 132, 133, and 134 to extend through the ground board 113. Thus, the short-circuiting section 114 is fixed between the dielectric member 111 and the ground board 113 and electrically connects the upper flat board 112 and the ground board 113.

One (134) of the side plates 131, 132, 133, and 134 is disposed to intersect the feed line 162. Therefore, the side plate 134 is provided with a recess 149 on one of the four sides of the rectangle that makes contact with the dielectric member 111 so that the side plate 134 does not make contact with the feed line 162.

The power feed conductor 115 includes a feed pin 161, the feed line 162, and a feed pin 163, as shown in FIG. 8.

The feed pin 161 is a conductor that extends through the dielectric member 111, with a first end being connected to part of the electronic components 117.

The feed line 162 is a strip line connected to a second end of the feed pin 161 and arranged to be in contact with the upper face 122 of the dielectric member 111. The upper flat board 112 has an opening formed in a portion where the feed line 162 is disposed as mentioned above. Therefore, the feed line 162 and the upper flat board 112 are electrically insulated from each other.

The feed pin 163 is a rod-like conductor and has one end connected to the feed line 162. The feed pin 163 is disposed to extend through the dielectric member 111 and to reach the ground board 113. Thus, the feed pin 163 electrically connects the feed line 162 and the ground board 113.

The spacers 116 are an insulating member disposed between the dielectric member 111 and the ground board 113 in order to keep the dielectric member 111 and the ground board 113 at the positions spaced apart a predetermined distance d. The spacers 116 are arranged between the dielectric member 111 and the ground board 113 to be positioned at four corners of the dielectric member 111.

The electronic components 117 are configured by an impedance matching circuit for impedance matching with a coaxial cable that connects a feed section 118 and the planar antenna device 101, and an amplifying circuit that amplifies a high frequency signal output from the feed section 118. The electronic components 117 are mounted on the lower face 123 of the dielectric member 111.

As described above, the planar antenna device 101 includes the upper flat board 112, the ground board 113, the short-circuiting section 114, and the power feed conductor 115.

The upper flat board 112 is a conductor formed in a board shape. The ground board 113 is a conductor formed in a board shape and disposed to face the upper flat board 112 with a space therebetween.

The short-circuiting section 114 is a conductor disposed between the upper flat board 112 and the ground board 113, has the housing space 130 formed for housing the electronic components 117, and is connected to both the upper flat board 112 and the ground board 113.

The power feed conductor 115 is a conductor that extends from an electronic component 117 disposed inside the short-circuiting section 114 toward the outside of the short-circuiting section 114 without being electrically connected to the short-circuiting section 114 and the upper flat board 112, and extends between the upper flat board 112 and the ground board 113 from the outside of the short-circuiting section 114 without being electrically connected to the upper flat board 112, to be electrically connected to the ground board 113.

In the planar antenna device 101 configured as described above, electric current flows along a path that starts from an electronic component 117 inside the short-circuiting section 114 and reaches the ground board 113 via the power feed conductor 115, and extends further from the ground board 113 and reaches the upper flat board 112 via the short-circuiting section 114.

Thus, the planar antenna device 101 can transmit electrical signals to the upper flat board 112 via the electronic components 117.

Since the short-circuiting section 114 is a conductor that is connected to both the upper flat board 112 and the ground board 113, the short-circuiting section 114 has a ground potential. Therefore, the influence of radiation electric fields of the planar antenna device 101 on the electronic components 117 housed inside the short-circuiting section 114 is very little, i.e., the electronic components are hardly affected by the electric fields generated outside the short-circuiting section 114 at an operating frequency in a zeroth mode.

Since the electronic components 117 are housed inside the short-circuiting section 114, the electric fields generated between the upper flat board 112 and the ground board 113 are hardly affected by the electronic components 117 inside the short-circuiting section 114.

This way, the planar antenna device 101 can minimize a loss in antenna performance resulting from the built-in electronic components 117.

In the embodiment described above, the planar antenna device 101 corresponds to an antenna device in the present disclosure. The upper flat board 112 corresponds to a first conductive plate in the present disclosure. The ground board 113 corresponds to a second conductive plate in the present disclosure. The housing space 130 corresponds to a housing space in the present disclosure. The short-circuiting section 114 corresponds to a short-circuiting section in the present disclosure. The power feed conductor 115 corresponds to a connecting section in the present disclosure.

Fourth Embodiment

Hereinafter, a fourth embodiment of the present disclosure will be described with reference to the drawings.

Figure 10:
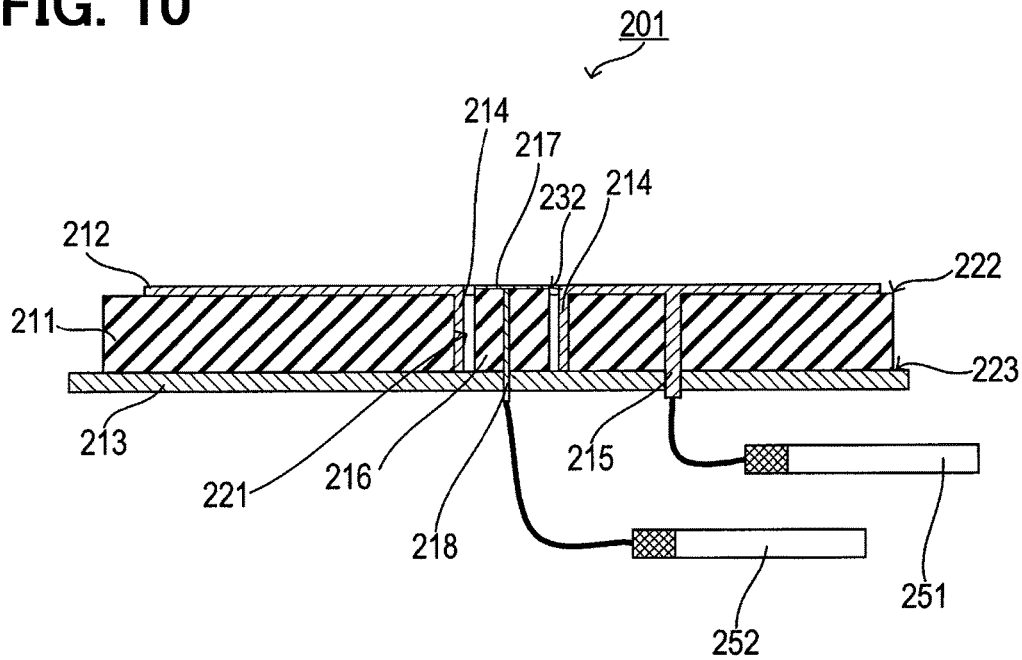
FIG. 10 is a cross-sectional view illustrating a planar antenna device 201 of a fourth embodiment.

A planar antenna device 201 of the present embodiment includes a dielectric member 211, an upper flat board 212, a ground board 213, a short-circuiting section 214, a feed pin 215, a second antenna dielectric member 216, a second antenna radiation element 217, and a second antenna dielectric member feed pin 218, as shown in FIG. 10. FIG. 10 is a cross-sectional view taken along arrow X-X in FIG. 11.

Figure 11:
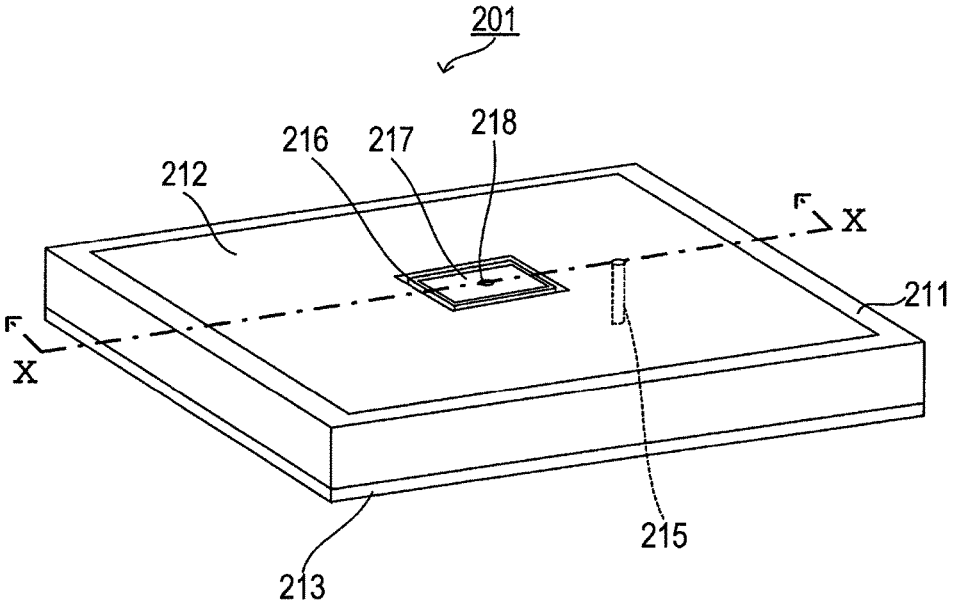
FIG. 11 is a perspective view illustrating the planar antenna device 201 of the fourth embodiment.

The dielectric member 211 is formed in a rectangular plate-like shape (see FIG. 11). A through hole 221 is formed in the dielectric member 211 to extend through the dielectric member 211. The through hole 221 has a size capable of housing the second antenna dielectric member 216 and the second antenna radiation element 217.

The upper flat board 212 is a conductive plate disposed to be in contact with an upper face 222 of the dielectric member 211. The dielectric member 211 is rectangular plate shaped. The upper flat board 212 is formed in a rectangular plate-like shape of a size that does not cover the peripheral edge of the upper face 222 (see FIG. 11). The upper flat board 212 further has an opening formed in a portion that faces the through hole 221.

The ground board 213 is a conductive plate disposed to be in contact with a lower face 223 of the dielectric member 211. The ground board 213 is formed to entirely cover the lower face 223. The ground board 213 is formed to close the through hole 221 in a portion that faces the through hole 221.

The short-circuiting section 214 is formed over the entire inner circumferential surface of the through hole 221. Thus, the short-circuiting section 214 electrically connects the upper flat board 212 and the ground board 213.

The feed pin 215 is a rod-like conductor, with a first end being connected to the upper flat board 212. The feed pin 215 extends through the dielectric member 211 and the ground board 213, and has a second end connected to a coaxial cable 251. The feed pin 215 and the ground board 213 are electrically insulated from each other.

The second antenna dielectric member 216 is formed in a rectangular plate-like shape with a size that allows the second antenna dielectric member 216 to be housed in the through hole 221 (see FIG. 11).

The second antenna radiation element 217 is a conductive plate disposed to be in contact with an upper face 232 of the second antenna dielectric member 216. The second antenna dielectric member 216 is rectangular plate shaped. The second antenna radiation element 217 is formed in a rectangular plate-like shape of a size that does not cover the peripheral edge of the second antenna dielectric member 216 (see FIG. 11).

The second antenna dielectric member feed pin 218 is a rod-like conductor, with a first end being connected to the second antenna radiation element 217. The second antenna dielectric member feed pin 218 extends through the second antenna dielectric member 216 and the ground board 213, and has a second end connected to a coaxial cable 252. The second antenna dielectric member feed pin 218 and the ground board 213 are electrically insulated from each other.

Therefore, the second antenna dielectric member 216, the second antenna radiation element 217, and the ground board 213 are integrated and function as a second antenna that operates independently from the antenna configured by the dielectric member 211, the upper flat board 212, and the ground board 213.

As described above, the planar antenna device 201 includes the upper flat board 212, the ground board 213, the short-circuiting section 214, and the feed pin 215.

The upper flat board 212 is a conductor formed in a board shape. The ground board 213 is a conductor formed in a board shape and disposed to face the upper flat board 212 with a space therebetween.

The short-circuiting section 214 is a conductor disposed between the upper flat board 212 and the ground board 213, has the through hole 221 formed for housing the second antenna dielectric member 216 and second antenna radiation element 217, and is connected to both the upper flat board 212 and the ground board 213. The feed pin 215 is a conductor electrically connected to the upper flat board 212.

The planar antenna device 201 configured as described above can transmit electrical signals from the upper flat board 212 to the outside of the planar antenna device 201 via the feed pin 215.

Since the short-circuiting section 214 is a conductor that is connected to both the upper flat board 212 and the ground board 213, the short-circuiting section 214 has a ground potential. Therefore, the second antenna housed inside the short-circuiting section 214 is hardly affected by the electric fields generated between the upper flat board 212 and the ground board 213.

Since the second antenna is housed inside the short-circuiting section 214, the electric fields generated between the upper flat board 212 and the ground board 213 are hardly affected by the second antenna inside the short-circuiting section 214.

In this way, the planar antenna device 201 can minimize a loss in antenna performance resulting from the built-in antenna.

In the embodiment described above, the planar antenna device 201 corresponds to an antenna device in the present disclosure. The upper flat board 212 corresponds to a first conductive plate in the present disclosure. The ground board 213 corresponds to a second conductive plate in the present disclosure. The through hole 221 corresponds to a housing space in the present disclosure. The short-circuiting section 214 corresponds to a short-circuiting section in the present disclosure. The feed pin 215 corresponds to a connecting section in the present disclosure.

Fifth Embodiment

Hereinafter, a fifth embodiment of the present disclosure will be described with reference to the drawings.

Figure 12:
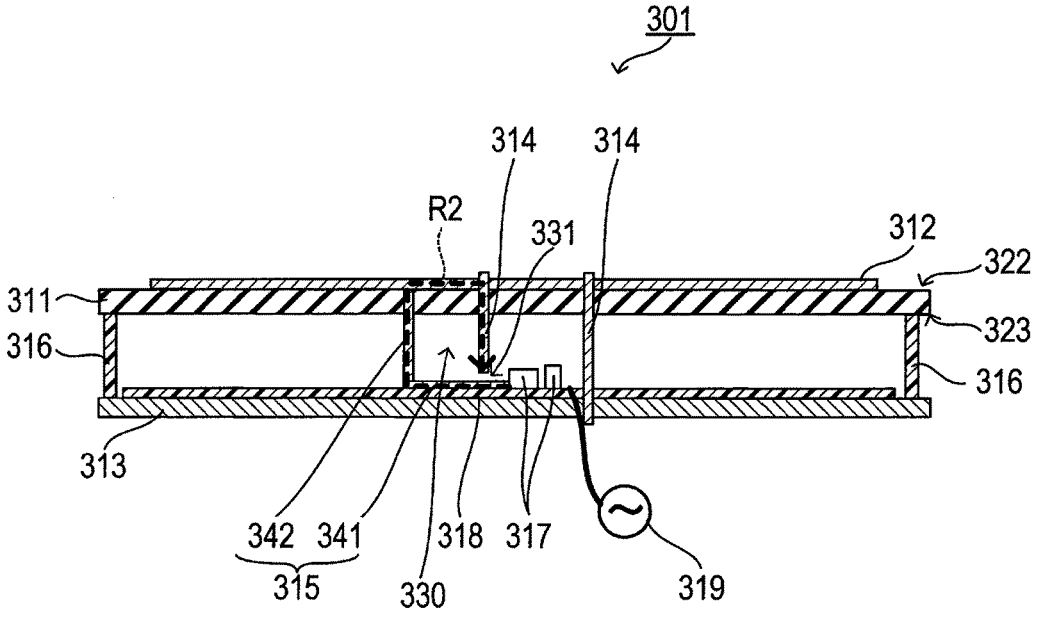
FIG. 12 is a cross-sectional view illustrating a planar antenna device 301 of a fifth embodiment.

A planar antenna device 301 of the present embodiment includes a dielectric member 311, an upper flat board 312, a ground board 313, a short-circuiting section 314, a power feed conductor 315, spacers 316, electronic components 317, and a circuit board 318, as shown in FIG. 12.

The dielectric member 311 is formed in a rectangular plate-like shape.

The upper flat board 312 is a conductive plate disposed to be in contact with an upper face 322 of the dielectric member 311. The dielectric member 311 is rectangular plate shaped. The upper flat board 312 is formed in a rectangular plate-like shape of a size that does not cover the peripheral edge of the upper face 322.

The ground board 313 is a conductive plate disposed to face the lower face 323 of the dielectric member 311 with the spacers 316 interposed between the ground board 313 and the dielectric member 311.

The short-circuiting section 314 has four side plates arranged between the dielectric member 311 and the ground board 313 in a rectangular tubular shape similarly to the short-circuiting section 114 of the third embodiment. The interior of the short-circuiting section 314 forms a housing space 330 for housing the electronic components 317. The short-circuiting section 314 is rectangular tubular shaped.

The four side plates are formed in rectangular, similarly to the side plates 131 to 134 of the third embodiment. Upper connecting pieces are provided on one of the four sides of the rectangle that makes contact with the dielectric member 311. Lower connecting pieces are provided to the four side plates on one of the four sides of the rectangle that makes contact with the ground board 313.

The upper connecting pieces protrude from the side plates to extend through the dielectric member 311 and the upper flat board 312, similarly to the upper connecting pieces 141 to 144 of the third embodiment. The lower connecting pieces protrude from the side plates to extend through the ground board 313, similarly to the lower connecting pieces 151 to 154 of the third embodiment. Thus the short-circuiting section 314 is fixed between the dielectric member 111 and the ground board 313 and electrically connects the upper flat board 312 and the ground board 313.

One of the four side plates is disposed to intersect a feed line 341. Therefore, this side plate is provided with a recess 331 on one of the four sides of the rectangle that makes contact with the ground board 313 so that the side plate does not make contact with the feed line 341.

The power feed conductor 315 includes the feed line 341 and a feed pin 342.

The feed line 341 is a strip line arranged on the circuit board 318 and has one end connected to part of the electronic components 317.

The feed pin 342 is a rod-like conductor and has one end connected to the feed line 341. The feed pin 342 is disposed to extend through the dielectric member 311 and to reach the upper flat board 312. Thus, the feed pin 342 electrically connects the feed line 341 and the upper flat board 312.

The spacers 316 are an insulating member disposed between the dielectric member 311 and the ground board 313 in order to keep the dielectric member 311 and the ground board 313 at the positions spaced apart a predetermined distance d. The spacers 316 are arranged between the dielectric member 311 and the ground board 313 to be positioned at four corners of the rectangular dielectric member 311.

The electronic components 317 are configured by an impedance matching circuit for impedance matching with a coaxial cable that connects a feed section 319 and the planar antenna device 301, and an amplifying circuit that amplifies a high frequency signal output from the feed section 319.

The circuit board 318 is formed in a board shape and carries the electronic components 317 mounted on the upper surface of the circuit board 318. The circuit board 318 is disposed between the dielectric member 311 and the ground board 313 with the lower surface in contact with the ground board 313.

In the planar antenna device 301 configured as described above, electric current flows along a current path R2 that starts from an electronic component 317 and reaches the ground board 313 via the power feed conductor 315, the upper flat board 312, and the short-circuiting section 314. Thus, the planar antenna device 301 generates vertical electric fields between the upper flat board 312 and the ground board 313 and emits radio waves from the edges of the upper flat board 312.

As described above, the planar antenna device 301 includes the ground board 313, the upper flat board 312, the short-circuiting section 314, and the power feed conductor 315.

The ground board 313 is a conductor formed in a board shape. The upper flat board 312 is a conductor formed in a board shape and disposed to face the ground board 313 with a space therebetween.

The short-circuiting section 314 is a conductor disposed between the ground board 313 and the upper flat board 312, has the housing space 330 formed for housing the electronic components 317, and is connected to both the ground board 313 and the upper flat board 312.

The power feed conductor 315 is a conductor that extends from an electronic component 317 disposed inside the short-circuiting section 314 toward the outside of the short-circuiting section 314 without being electrically connected to the short-circuiting section 314 and the ground board 313, and extends between the ground board 313 and the upper flat board 312 from the outside of the short-circuiting section 314 without being electrically connected to the ground board 313, to be electrically connected to the upper flat board 312.

In the planar antenna device 301 configured as described above, electric current flows along a current path that starts from an electronic component 317 inside the short-circuiting section 314 and reaches the upper flat board 312 via the power feed conductor 315.

Thus, the planar antenna device 301 can transmit electrical signals to the upper flat board 312 via the electronic components 317.

Since the short-circuiting section 314 is a conductor that is connected to both the ground board 313 and the upper flat board 312, the short-circuiting section 314 has a ground potential. Therefore, the influence of radiation electric fields of the planar antenna device 301 on the electronic components 317 housed inside the short-circuiting section 314 is very little, i.e., the electronic components are hardly affected by the electric fields generated outside the short-circuiting section 314 at an operating frequency in a zeroth mode.

Since the electronic components 317 are housed inside the short-circuiting section 314, the electric fields generated between the upper flat board 312 and the ground board 313 are hardly affected by the electronic components 317 inside the short-circuiting section 314.

This way, the planar antenna device 301 can minimize a loss in antenna performance resulting from the built-in electronic components 317.

In the embodiment described above, the planar antenna device 301 corresponds to an antenna device in the present disclosure. The ground board 313 corresponds to a first conductive plate in the present disclosure. The upper flat board 312 corresponds to a second conductive plate in the present disclosure. The housing space 330 corresponds to a housing space in the present disclosure. The short-circuiting section 314 corresponds to a short-circuiting section in the present disclosure. The power feed conductor 315 corresponds to a connecting section in the present disclosure.

While some embodiments of the present disclosure have been described above, the present disclosure is not limited to the embodiments described above, and can adopt various forms as long as they fall within the technical scope of the present disclosure.

For example, the planar antenna device 1 shown in the first embodiment is used as a transmitting antenna that emits radio waves from the edges of the upper flat board 12 by transmitting electric signals to the upper flat board 12 via the electronic components 41. Instead, the planar antenna device 1 may be used as a receiving antenna that transmits electrical signals from the upper flat board 12 to the electronic components via the power feed conductor 15.

The electronic components 41 shown in the first embodiment are configured by an impedance matching circuit, amplifying circuit, and the like. However, any electronic components may be housed inside the short-circuiting section 14 and they are not limited to impedance matching circuits, amplifying circuits, and the like. Electronic components here refer to parts used in electronic equipment. Electronic components are roughly divided into active parts, passive parts, and mechanical parts. Active parts include transistors, diodes and the like. Passive parts include resistors, capacitors and the like. Mechanical parts include connectors, wires and the like.

The function of one constituent element in any of the embodiments described above may be divided and served by several constituent elements, or the functions of several constituent elements may be integrated and served by a single constituent element. At least some features of the configuration in any of the embodiments described above may be replaced by a known configuration that has similar functions. Alternatively, part of the configuration in any of the embodiments described above may be omitted. At least some features of the configuration in any of the embodiments described above may be added to or used instead of the configuration of other embodiments. Any and all forms contained in the technical idea that is specified only by the wordings of the claims shall be the embodiments of the present disclosure.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. An antenna device comprising:

a first conductive plate that is a conductor formed in a board shape;

a second conductive plate that is a conductor formed in a board shape and disposed to face the first conductive plate with a space therebetween;

a short-circuiting section that is a conductor disposed between the first conductive plate and the second conductive plate, has a housing space formed for housing an electronic component, and is connected to both the first conductive plate and the second conductive plate; and a connecting section that is a conductor that extends from the electronic component disposed inside the short-circuiting section toward the outside of the short-circuiting section without being electrically connected to the short-circuiting section and the first conductive plate, and extends between the first conductive plate and the second conductive plate from the first conductive plate toward the second conductive plate or from the second conductive plate toward the first conductive plate without being electrically connected to the first conductive plate, to be electrically connected to the second conductive plate, wherein the electronic component is exposed to outside of the antenna device through the housing space.

2. The antenna device according to claim 1, further comprising:

a dielectric member that is disposed between the first conductive plate and the second conductive plate and has a through hole configuring the housing space, wherein the short-circuiting section includes a plurality of through hole conductors that are disposed outside the through hole so as to surround the through hole, and that extend through the dielectric member.

3. The antenna device according to claim 1, further comprising:

the connecting section includes a first part that has an end connected to the electronic component and extends toward the outside of the short-circuiting section, and a second part that has an end connected to the second conductive plate and extends toward the first conductive plate.

4. The antenna device according to claim 1, wherein the housing space is covered by the short-circuiting section and the second conductive plate except for a portion through which the electronic component is exposed to outside of the antenna device.

* * * * *